US006732513B2

(12) United States Patent
Tajima

(10) Patent No.: US 6,732,513 B2
(45) Date of Patent: May 11, 2004

(54) ROTATING CONTROL CIRCUIT

(75) Inventor: Kazuharu Tajima, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 10/255,957

(22) Filed: Sep. 27, 2002

(65) Prior Publication Data

US 2003/0061743 A1 Apr. 3, 2003

(30) Foreign Application Priority Data

Sep. 28, 2001 (JP) ..... 2001-301042

(51) Int. Cl.[7] ..... F15B 11/00; E02F 9/22
(52) U.S. Cl. ..... 60/468; 60/469
(58) Field of Search ..... 60/454, 468, 469, 60/494

(56) References Cited

U.S. PATENT DOCUMENTS

| | | | | |
|---|---|---|---|---|
| 5,419,132 A | * | 5/1995 | Sato et al. | 60/468 |
| 6,378,303 B1 | | 4/2002 | Higuchi et al. | 60/468 |
| 6,532,738 B2 | * | 3/2003 | Sharkness et al. | 60/468 |

FOREIGN PATENT DOCUMENTS

| | | |
|---|---|---|
| JP | 56-45602 | 4/1981 |
| JP | 57-11305 | 1/1982 |
| JP | 57-190104 | 12/1982 |
| JP | 63-172002 | 7/1988 |
| JP | 5-42706 | 6/1993 |
| JP | 9-71977 | 3/1997 |
| JP | 9-126204 | 5/1997 |
| JP | 2000-8423 | 1/2000 |
| JP | 2000-170212 | 6/2000 |
| JP | 2001-27202 | 1/2001 |
| JP | 2001-65506 | 3/2001 |

* cited by examiner

*Primary Examiner*—Thomas E. Lazo
(74) *Attorney, Agent, or Firm*—Oblon, Spivak, McClelland, Maier & Neustadt, P.C.

(57) ABSTRACT

A hydraulic motor is rotationally driven as pressure oil from a hydraulic pump is supplied by way of a control valve. A remote control valve is adapted to switch the control valve. A bypath line is connected to both hydraulic lines of the hydraulic motor. A communicating valve has a position for closing the bypath line and a position for opening the bypath line. A throttle valve controls the communicating valve, wherein the throttle valve is adapted to set the communicating valve to a closed position at the time when the remote control valve is operated for rotating, and to set the communicating valve to an open position at the time when the remote control valve is returned to a neutral position, as well as to allow the pressure oil of deceleration side to be released by a predetermined time, whereby the flapping of the machine which may be caused, such as at the time when the rotation is stopped in the hydraulic excavator, can be avoided.

8 Claims, 4 Drawing Sheets

ROTATING CONTROL CIRCUIT

BACKGROUND OF THE INVENTION

1. Field of the Invention

The present invention relates to a rotating control circuit, in particular to a rotating control circuit for a construction machine.

2. Description of the Related Art

A hydraulic excavator, especially a hydraulic excavator with short tail swing radius has a small inertia force of upperrotating body at the time of stopping a rotating operation. For this reason, when the rotating operation is abruptly stopped, a machine body of the excavator may be flapped. Furthermore, for the same reason, the machine body may also be flapped at the time of starting the rotation.

SUMMARY OF THE INVENTION

It is an object of the present invention to provide a rotating control circuit which can avoid a flapping of a machine body at the time of stopping the rotation of upper rotating body of construction machine and the like.

A construction machine according to the present invention has a rotating control circuit for a working machine provided with a rotating body, wherein the rotating control circuit comprises:

a hydraulic motor adapted to be rotationally driven by supplying hydraulic fluid from hydraulic fluid source by way of a direction control valve; operating means adapted to switch the direction control valve between a rotating position and a neutral position; a bypath line connected between both hydraulic lines of the hydraulic motor; a communicating valve having switch positions comprising a first position for closing the bypath line and a second position for opening the bypath line; and a controller adapted to control the switch positions of the communicating valve. The controller is adapted to set the communicating valve to the first position at the rotating position or the neutral position and to set the communicating valve to the second position when the communicating valve is switched to a position different from the first position, as well as to allow the hydraulic fluid of deceleration side at the time of stopping the rotation, and the hydraulic fluid of acceleration side at the time of starting the rotation, to be released by a predetermined time.

The afore-mentioned "a position different from the first position" is illustrated by two cases as follows:

First is the case where said controller is adapted to set an escape valve or a bypath valve to a closed position at the time when the operating means is operated for rotation, and to set the bypath valve to an open position at the time when the operating means is returned to the neutral position, thereby allowing the hydraulic fluid of deceleration side to be released by the predetermined time.

In this case, a reverse motion of motor torque changed from acceleration to deceleration is delayed at the time of stopping the rotating operation. Thereby, an abrupt stopping will not be caused in the construction machine, in particular even if the inertia force of upper rotating body is small as in the hydraulic excavator with short tail swing radius, and there will be no flapping of a machine body of the excavator.

Therefore, an operator does not feel lurch with his (her) body at the time of stopping the rotating operation and a comfortable maneuverability can be attained.

Next is the case where said controller is adapted to set the communicating valve to the first position at the time when said operating means is in the neutral position and to set the communicating valve to the second position at the time when the rotating operation is started, thereby allowing the hydraulic fluid of acceleration side to be released by the predetermined time.

In this case, an acceleration of motor torque is delayed at the time of starting the rotation. Therefore, even if the inertia force of upper rotating body is small as in the hydraulic excavator with short tail swing radius, the abrupt rotation will not be caused. As a result, there will be no rocking of hull. Thereby, the operator does not feel large rocking with his (her) body at the time of starting the rotation, whereby a comfortable maneuverability can be attained.

DESCRIPTION OF THE PREFERRED EMBODIMENTS

Figure 1:
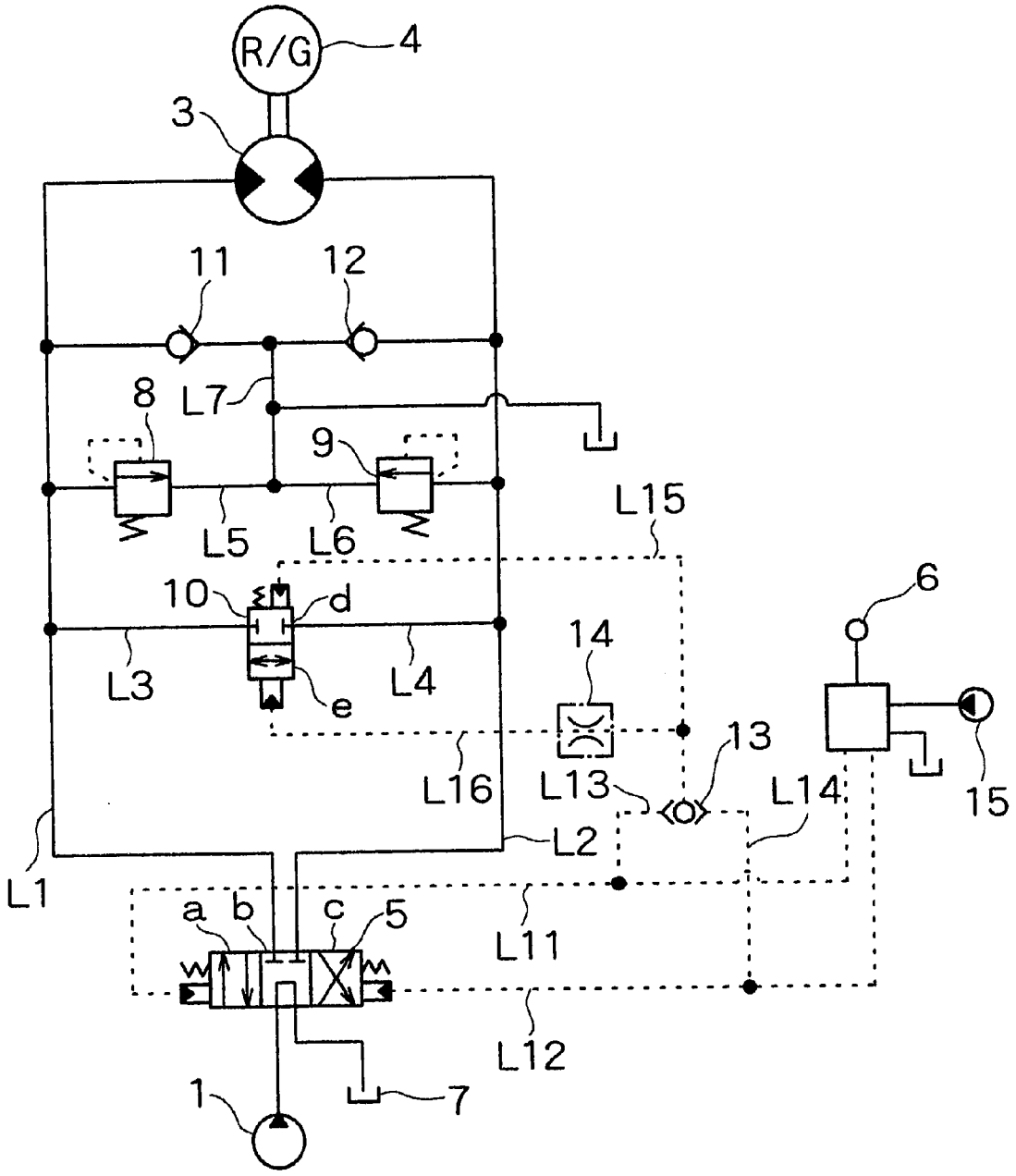
FIG. 1 is a diagram of rotating control circuit of hydraulic excavator according to the first embodiment of the present invention.

Hereinafter, each of the preferred embodiments of rotating control circuit according to the present invention will be described with reference to FIGS. 1 to 4. This is one embodiment of the present invention and the present invention is not limit thereto.

A hydraulic excavator, to which a rotating control circuit according to the present invention is applied, is generally provided with an upper rotating body on a lower traveling body. A hydraulic motor is employed in the rotating mechanism of the upper rotating body. The hydraulic motor is rotationally driven to perform a rotation by supplying hydraulic fluid from hydraulic fluid source such as a hydraulic pump by way of a direction control valve. When the rotation is stopped, the direction control valve is switched to the neutral position.

In the following embodiments, identical parts will be indicated by an identical reference numeral and only the different points thereof will be described without being repeatedly described.

First Embodiment

FIG. 1 is a diagram of rotating control circuit of hydraulic excavator according to the first embodiment of the present invention. In the figure, solid lines indicate hydraulic lines and broken lines indicate pilot lines.

In FIG. 1, a hydraulic pump 1 as a hydraulic fluid source and a hydraulic motor 3 rotationally driven by pressure oil as hydraulic fluid from the pump 1 are connected with each other by both hydraulic lines L1, L2 through a control valve 5 as a direction control valve.

The hydraulic pump 1 is of variable displacement type, which is driven by an engine (not shown). The hydraulic motor 3 revolves an upper rotating body (not shown) of hydraulic excavator via a deceleration mechanism 4.

The control valve 5 is of hydraulic pilot type, which is adapted to be switched to any of three switch positions a, b and c by a pilot pressure from a remote control valve 6 as an operating means. Among these, b is the neutral position. The remote control valve 6 generates the pilot pressure as an operating signal of the control valve 5 by transforming a hydraulic pressure from a pilot pump 15 into a secondary pressure in response to the manipulation of operating lever.

In FIG. 1, the remote control valve 6 is in the neutral position, and thus the pilot lines L11, L12 are not pressurized. Due to this, a spool of the control valve 5 is in the neutral position b. In this neutral position b, the pressure oil from the hydraulic pump 1 is all returned to a tank 7 and the both hydraulic lines L1, L2 of the hydraulic motor 3 are blocked. Therefore, under this condition, the hydraulic motor 3 will revolve to neither left nor right directions. Thus, the upper rotating body will be maintained in a stopped condition or in a halt condition.

A rightward rotation is instructed by manipulating the lever of the remote control valve 6. In this case, the pilot line L11 is pressurized and the spool of the control valve 5 is switched to other position. In the switch position a, the pressure oil from the hydraulic pump 1 is supplied to the hydraulic motor 3 by way of the line L1. As a result, the hydraulic motor 3 is rotationally driven to the direction where the upper rotating body revolves rightward. And, the pressure oil discharged from the hydraulic motor 3 is returned to the tank 7 by way of the line L2.

A leftward rotation or a left-hand rotation is instructed by manipulating the lever of the remote control valve 6. In this case, the pilot line L12 is pressurized and the spool of the control valve 5 is switched to other position. In the switch position c, the pressure oil from the hydraulic pump 1 is supplied to the hydraulic motor 3 by way of the line L2. As a result, the hydraulic motor 3 is rotationally driven to the direction where the upper rotating body revolves leftward. And, the pressure oil discharged from the hydraulic motor 3 is returned to the tank 7 by way of the line L1.

Overload relief valves 8, 9 and a communicating valve 10 as a bypath valve are provided between the both hydraulic lines L1, L2.

The overload relief valves 8, 9 have a same construction with a direct driven relief valve. By operating these relief valves, a brake pressure is generated. Bypath lines L5, L6 of respective relief valves 8, 9 are connected with each other. Furthermore, they are introduced into the tank via a connecting line L7. Alternatively, they are connected to the both hydraulic lines L1, L2 of the hydraulic motor 3 via check valves 11, 12.

The communicating valve 10 is of hydraulic pilot type. This valve 10 is so compact that it can be affixed to the hydraulic motor 3 or built in a reverse-preventing passageway of the hydraulic motor 3. The valve 10 is connected to the both hydraulic lines L1, L2 of the hydraulic motor 3 by bypath lines L3, L4. The valve 10 is switched to either switch positions d or e by pilot pressure from the remote valve 6. Between said two positions, the switch position d is the neutral position.

For the purpose of switching operation of the communicating valve 10, lines L13, L14 are branched from the pilot lines L11, L12, respectively. Both of the lines L13, L14 are connected to the pilot lines L15, L16 of the communicating valve 10 via a shuttle valve 13. The pilot line L16 is provided with a throttle valve 14 as a controller. The throttle valve 14 controls the communicating valve 10 as explained below. The valve 14 can simply change the operating time (predetermined time) of the communicating valve 10 by selecting its size, in spite of its inexpensiveness and simple constitution. For this reason, it is possible to easily cope with needs of customers.

Hereinafter, the description will be made for the operation of communicating valve, which is one of the characteristic features of the present invention, as the subject.

In FIG. 1, the remote control valve 6 is in the neutral position, and the pilot lines L11, L12 are not pressurized. For this reason, the spool of the communicating valve 10 is switched to the switch position d. In the switch position d, the bypath lines L3, L4 from the communicating valve 10 are blocked together. Furthermore, the pressure oil from the hydraulic pump 1 is all returned to the tank 7, and the both hydraulic lines L1, L2 of hydraulic motor 3 are blocked. Therefore, under this condition, the hydraulic motor 3 will revolve to neither left nor right directions. For this reason, the upper rotating body is remained in the stopped condition as ever.

The rightward rotation is instructed by manipulating the lever of the remote control valve 6. In this case, because the pilot line L11 is pressurized, the spool of the control valve 5 is switched to the switch position a. The pressure of pilot line L11 is transmitted to the pilot line L15 by way of the branch line L13 and the shuttle valve 13. After a little while, the pressure is also transmitted to the pilot line L16. In this case, the spool of the communicating valve 10 is in the state of the switch position d as it stands without being switched.

Then, the return-to-neutral is instructed by manipulating the lever of the remote control valve 6. In this case, the pilot line L11 is not pressurized and the spool of the control valve 5 is switched to the neutral position b. At this time, the pressure of the pilot line L15 of the communicating valve 10 is opened or released by way of the shuttle valve 13 and the branch lines L13, L14. Meanwhile, the pressure of the pilot line L16 is maintained in a condition higher than the pressure of the pilot line L15 by a predetermined time by the action of the throttle valve 14. Within this predetermined time, the spool of the communicating valve 10 is switched to the switch position e.

In the switch position e, the bypath lines L3, L4 from the communicating valve 10 are communicated with each other. Thereby, the both hydraulic lines L1, L2 of the hydraulic motor 3 are turned to the communicated state. Even in this case, the pressure oil from the hydraulic pump 1 is also all returned to the tank 7 and the both hydraulic lines L1, L2 of the hydraulic motor 3 are blocked by the control valve 5. In this case, the pressure oil from the line L2 is returned to the line L1 by the communication of said bypath lines L3, L4, thereby preventing abrupt pressure rise in the line L2.

After the predetermined time, the pressure of the pilot line 16 is turned to be as same as the pressure of the pilot line 15 and the spool of the communicating valve 10 is switched so that it springs back to be returned to the original switch position d. Thereby, the bypath lines L3, L4 from the communicating valve 10 are blocked together. In addition, the pressure oil from the hydraulic pump 1 is all returned to the tank 7, and the both hydraulic lines L1, L2 of the hydraulic motor 3 are blocked.

And, the overload relief valve 9 is operated and the brake pressure is applied, whereby the upper rotating body is stopped. At this time, the abrupt pressure rise in the line L2 is prevented by the action of said communicating valve 10. Therefore, the upper rotating body slowly comes to be stopped. In this case, although the hydraulic motor 3 continuously performs the rightward rotation by the predetermined time, there is no substantial problem. The above case may be identically applied to the case where the leftward rotation is instructed by manipulating the lever of the remote control valve 6.

According to this embodiment, the communicating valve 10 is set to the switch position d (closed position) at the time when the remote control valve 6 is manipulated for rotating and set to the switch position e (open or release position) at the time when the remote control valve 6 is returned to the neutral, thereby functioning to allow the pressure oil of deceleration side to be escaped by a predetermined time. Accordingly, the inverse action of motor torque changed from acceleration to deceleration is delayed at the time of stopping the rotating operation. Therefore, no abrupt stop will be caused in a hydraulic excavator, in particular even if the inertia force of the upper rotating body is small as in a hydraulic excavator with short tail swing radius, and there will be no flapping of the machine body. Thereby, the operator does not feel lurch with his (her) body at the time of stopping the rotating operation, so that a comfortable maneuverability can be attained.

As described above, if the bypath lines are provided in the state of connecting the both hydraulic lines of hydraulic motor and constructed to allow the pressure oil as the hydraulic fluid to be escaped from the deceleration side to the acceleration side in the state where the bypath valve is set to the open position, it becomes needless to supplement the pressure oil. Therefore, it makes maintenance for the work machine easier.

Second Embodiment

The hydraulic excavator, especially the hydraulic excavator with short tail swing radius also suffers from the flapping of the machine body at the time of starting the rotation due to the reasons as same as the reasons described in said first embodiment. According to the second embodiment, it is possible to prevent the flapping of the machine body at the time of starting the rotation.

Figure 2:
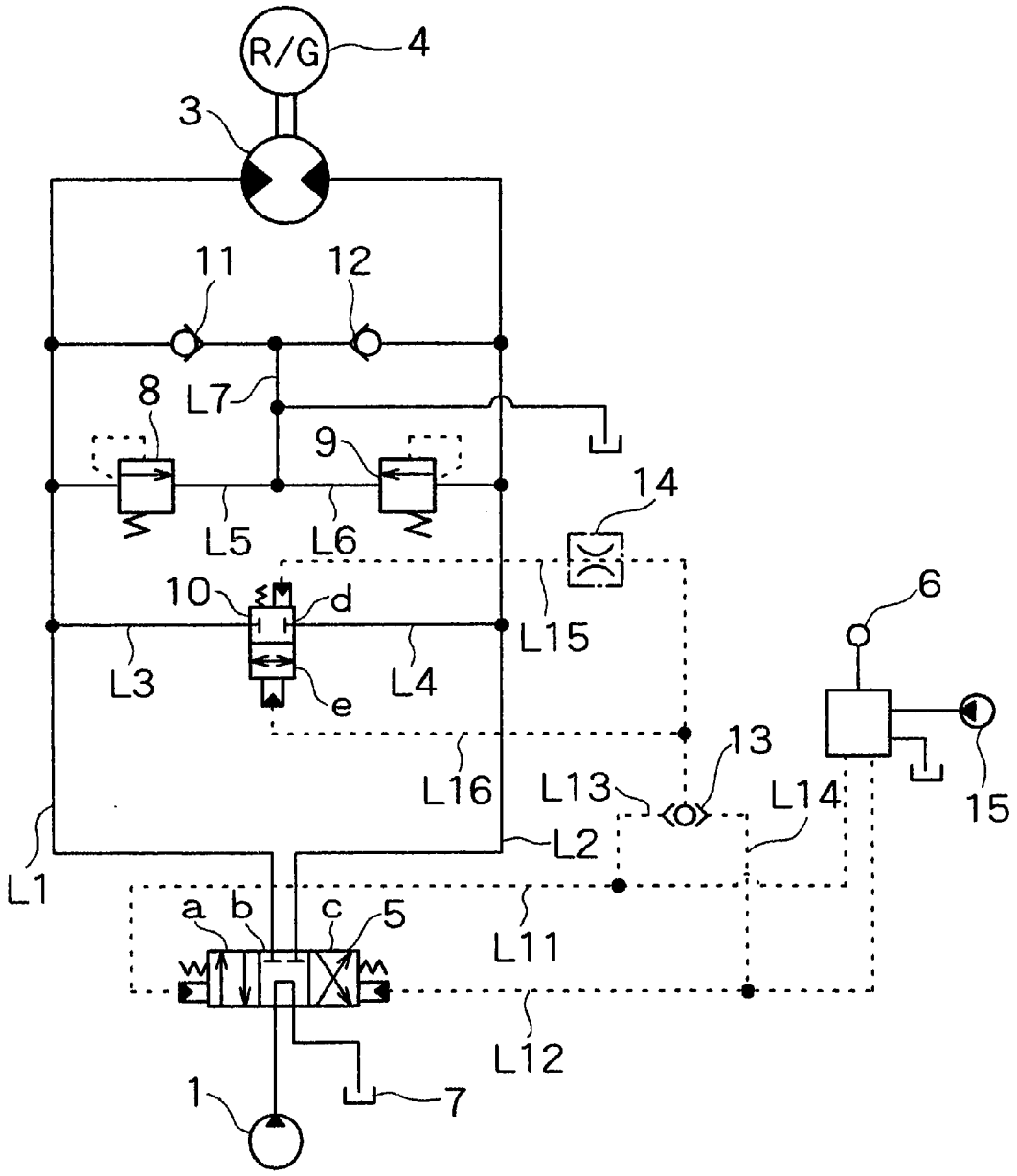
FIG. 2 is a diagram of rotating control circuit of hydraulic excavator according to the second embodiment of the present invention.

FIG. 2 shows a diagram of rotating control circuit of the hydraulic excavator according to the second embodiment of the present invention. In FIG. 2, the throttle valve 14 as a controller is not present in the pilot line L16 of communicating valve 10 but is provided in the pilot line L15. The other construction is completely identical to the first embodiment and thus the description thereof will be omitted.

In FIG. 2, because the remote control valve 6 is in the neutral position, the pilot lines L11, L12 are not pressurized. For this reason, the spool of the communicating valve 10 is in the switch position d. In this switch position d, the bypath lines L3, L4 from the communicating valve 10 are blocked together. In addition, the pressure oil from the hydraulic pump 1 is all returned to the tank 7, and the both hydraulic lines L1, L2 of the hydraulic motor 3 are blocked. Therefore, under this condition, the hydraulic motor 3 will revolve to neither left nor right directions. Thereby, the upper rotating body is maintained in the stopped state or in a pause.

The rightward rotation is instructed by manipulating the lever of the remote control valve 6. In this case, because the pilot line L11 is pressurized, the spool of the control valve 5 is switched to the switch position a. The pressure of pilot line L11 is transmitted to the pilot line L16 by way of the branch line L13 and shuttle valve 13. In this case, the pressure of the pilot line L15 is maintained in the state of being lower than that of the pilot line L16 by a predetermined time by the action of throttle valve 14. Within this predetermined time, the spool of the communicating valve 10 is switched to the switch position e.

In the switch position e, the bypath lines L3, L4 from the communicating valve 10 are turned to the state where they are communicated with each other. At this time, the pressure oil from the hydraulic pump 1 is supplied to the line L1 via the control valve 5. The pressure oil of this line L1 is sent to the line L2 and then returned to the tank 7, thereby preventing the abrupt pressure rise in the line L1.

After the predetermined time, the pressure of the pilot line L15 becomes equal to the pressure of the pilot line L16. For this reason, the spool of the communicating valve 10 is switched so that it springs back to be returned to the former switch position d. Thereby, the bypath lines L3, L4 from the communicating valve 10 are blocked together.

As such, the pressure oil from the hydraulic pump 1 is supplied to the hydraulic motor 3 by way of the control valve 5 and line L1. As a result, the hydraulic motor 3 is rotationally driven in the direction for rotating the upper rotating body rightward. And, the pressure oil discharged from the hydraulic motor 3 is returned to the tank 7 by way of the line L2. The above may be identically applied to the case where the leftward rotation is instructed by manipulating the lever of the remote control valve 6.

According to this embodiment, the communicating valve 10 is set to the switch position d (closed position) at the time when the remote control valve 6 is in the neutral. In this case, the communicating valve 10 is set to the switch position e (open or release position) at the time of starting the rotation, thereby functioning to allow the pressure oil of acceleration side to be escaped or released by a predetermined time. Thereby, the acceleration of motor torque is delayed at the time of starting the rotation. Therefore, no abrupt rotation will be caused in the hydraulic excavator, in particular even if the inertia force of upper rotating body is small like the hydraulic excavator with short tail swing radius. As a result, there will be no flapping of the machine body. Due to this, the operator does not feel lurch with his (her) body at the time of starting the rotation, whereby a comfortable maneuverability can be attained.

Therefore, this embodiment provides a rotating control circuit comprising: a hydraulic motor rotationally driven as the pressure oil from a pressure oil source is supplied via a direction control valve; an operating means adapted to switch the direction control valve; a bypath line connected to both hydraulic lines of the hydraulic motor; a bypath valve having a position for closing the bypath line and a position for opening the bypath line; a controller for controlling the bypath valve, wherein said controller is adapted to set the bypath valve to the closed position at the time when the operating means is in the neutral and to set the bypath valve to the open position at the time when the rotating operation is started, thereby allowing the pressure oil of acceleration side to be escaped by a predetermined time.

According to this construction, because the bypath valve is set to the closed position at the time when the operating means is in the neutral and set to the open position at the time when the rotating operation is started, thereby allowing the pressure oil of the acceleration side to be escaped by a predetermined time, the accelerating operation of motor torque is delayed at the time of starting the rotating operation. Therefore, no abrupt rotation will be caused in the hydraulic excavator, in particular even if the inertia force of upper rotating body is small like the hydraulic excavator with short tail swing radius and there will be no flapping of the machine body.

Therefore, the operator does not feel lurch with his (her) body at the time of starting the rotation, whereby a comfortable maneuverability can be attained.

Furthermore, said first and second embodiments provides the throttle valve 14 as the controller in the pilot line L15 or L16 of the communicating valve 10 to set the communicating valve 10 to the open position by a predetermined time.

As described above, the communicating valve 10 as an bypath valve is of hydraulic pilot type, and the throttle valve 14 as a controller is installed in the pilot line of said bypath valve, whereby there is provided with throttling to set the bypath valve to the open position by a predetermined time. Thereby, the reverse motion of the motor torque changed from acceleration to deceleration is delayed with a simple construction at the time of stopping the rotating operation.

Figure 3:
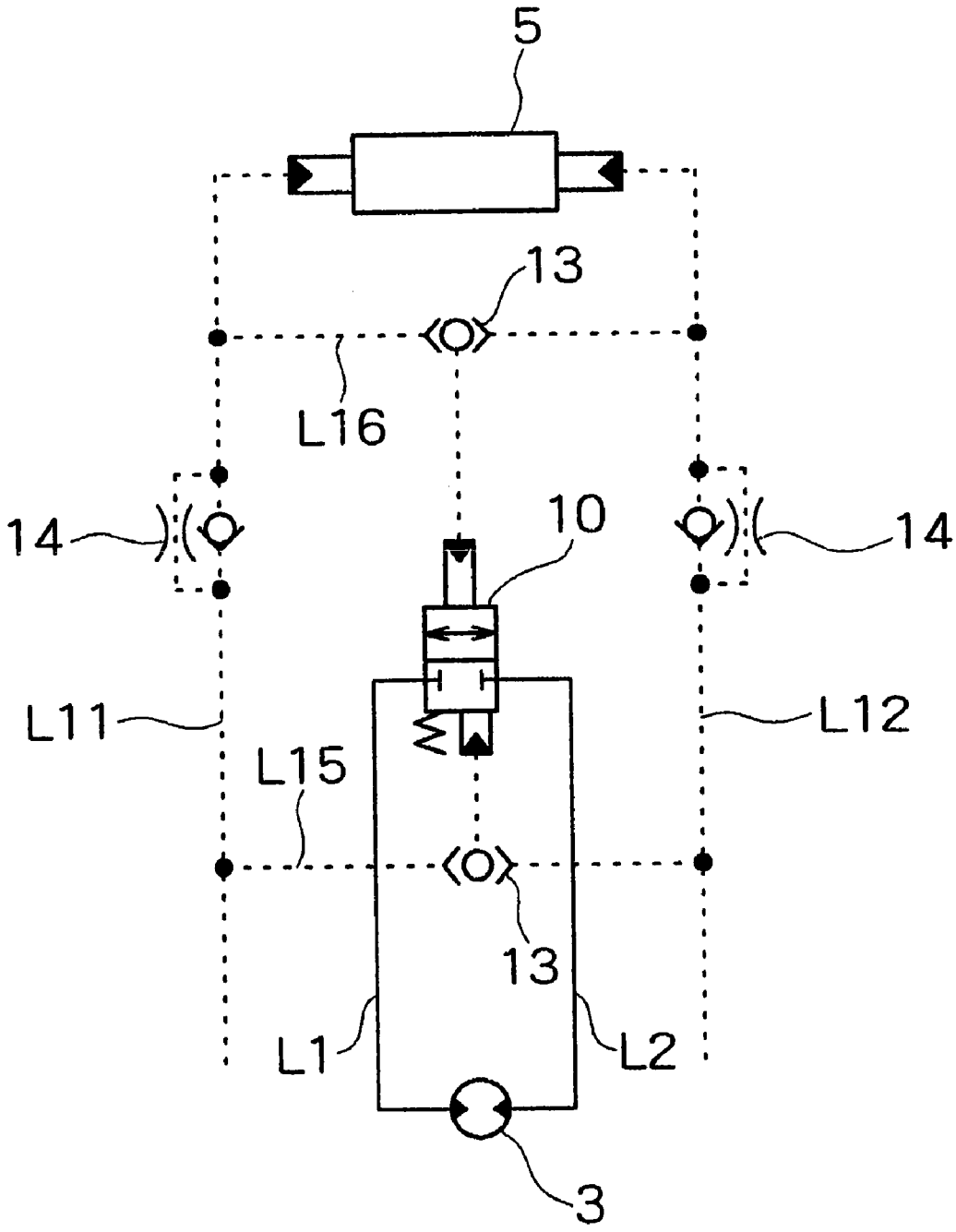
FIG. 3 is a diagram of partial rotating control circuit of hydraulic excavator according to the first modified embodiment of the present invention.

The throttle valve 14 may be substituted with a slow return check valve as in the first modified embodiment shown in FIG. 3. In addition, FIG. 3 shows an example adapted to delay the operating time of said communicating valve 10 using the stroke volume of the control valve 5.

In said first and second embodiments, the communicating valve 10 is of hydraulic pilot type and takes a more simple construction operated by the pilot pressure from the remote control valve 6.

Like this, if the bypath valve is adapted to be operated by the pilot pressure from the remote control valve 6 as operating means, an exclusive source of pilot pressure will be unnecessary and the construction becomes more simplified.

If it is impossible to form a branch from the pilot lines L11, L12 of the control valve 5, an exclusive source of pilot pressure may be provided. Furthermore, the communicating valve 10 may be of pneumatic pilot type or solenoid type. The opening area at the time of communicating the communicating valve 10 is not needed to be always constant. For example, if the opening area of communicating valve is adapted to be controllable, the communicating valve can produce a brake pressure.

Figure 4:
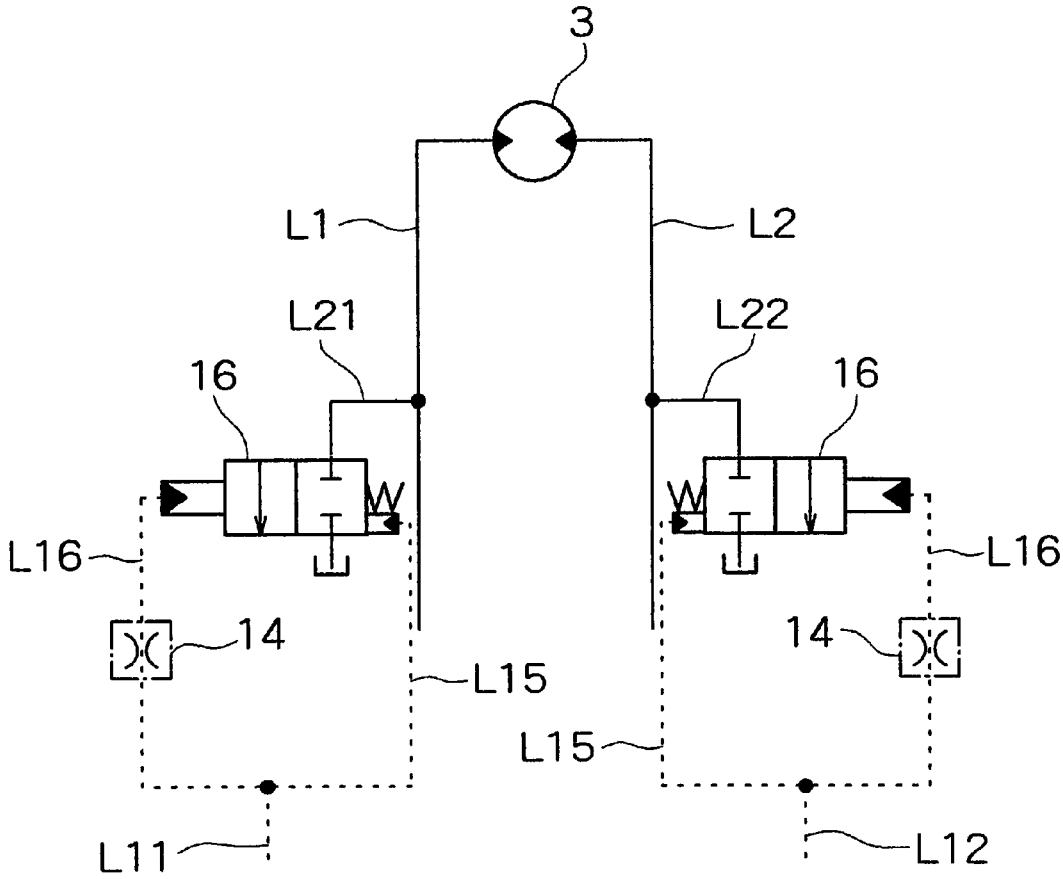
FIG. 4 is a diagram of partial rotating control circuit of hydraulic excavator according to the second modified embodiment of the present invention.

In addition, unload valves 16, 16 may be individually provided in the both hydraulic lines L1, L2 of the hydraulic motor 3 instead of the communicating valve 10 as in the second modified embodiment shown in FIG. 4 to individually introduce each of the bypath lines L21, L22 into the tank. In this case, it is preferable to provide a supplementary line which is not shown, so that shortage caused by allowing the pressure oil to be escaped to the tank is supplemented into the line L1 or L2.

Although an embodiment of the present invention is disclosed in the above, the scope of protection of the present invention is not limited thereto.

I claim:

1. A rotating control circuit for a working machine with a rotating body, comprising:

a hydraulic motor rotationally driven by supplying pressure oil from a hydraulic oil source via a direction control valve;

an operating means adapted to switch said direction control valve between a rotating position and a neutral position;

a bypath line connected between both hydraulic lines of said hydraulic motor;

a pilot operated communicating valve operated by a pilot signal from the operating means and having switch positions with a first position and a second position, the first position being for closing said bypath line and the second position being for opening said bypath line; and a controller positioned to affect the pilot signal of said communicating valve and adapted to control the switch positions of said communicating valve, wherein the controller is adapted to set the communicating valve to the first position at said rotating position or said neutral position and then to set the communicating valve to the second position when the operating means is operated to be switched to said neutral position or said rotating position, respectively, as well as to allow the pressure oil of deceleration side at the time of stopping rotation, or the pressure oil of acceleration side at the time of starting rotation to be released by a predetermined time.

2. The rotating control circuit according to claim 1, wherein said controller is adapted to set said communicating valve to the first position at the rotating position of the time when said operating means is operated for rotating and to set said communicating valve to the second position at the time when the operating means is returned to the neutral position, as well as to allow the pressure oil of deceleration side to be released by a predetermined time.

3. The rotating control circuit according to claim 1, wherein said communicating valve is of hydraulic pilot type.

4. The rotating control circuit according to claim 1, wherein said bypath line is provided in the state of connecting said both hydraulic lines of said hydraulic motor, and adapted to allow the pressure oil to be released from the deceleration side to the acceleration side in the state where said communicating valve is set to the second position.

5. A rotating control circuit for a working machine with a rotating body, comprising:

a hydraulic motor rotationally driven by supplying pressure oil from a hydraulic oil source via a direction control valve;

an operating means adapted to switch said direction control valve between a rotating position and a neutral position;

a bypath line connected between both hydraulic lines of said hydraulic motor;

a communicating valve having switch positions with a first position and a second position, the first position being for closing said bypath line and the second position being for opening said bypath line; and a controller adapted to control the switch positions of said communicating valve, wherein the controller is adapted to set the communicating valve to the first position at said rotating position or said neutral position and then to set the communicating valve to the second position when the operating means is operated to be switched to said neutral position or said rotating position, respectively, as well as to allow the pressure oil of deceleration side at the time of stopping rotation, or the pressure oil of acceleration side at the time of starting rotation to be released by a predetermined time, wherein said controller is adapted to set said communicating valve to the first position when said operating means is in the neutral position and to set said communicating valve to the second position at the rotating position of the time when a rotating operation is started, as well as to allow the pressure oil of acceleration side to be released by a predetermined time.

6. A rotating control circuit for a working machine with a rotating body, comprising:

a hydraulic motor rotationally driven by supplying pressure oil from a hydraulic oil source via a direction control valve;

an operating means adapted to switch said direction control valve between a rotating position and a neutral position;

a bypath line connected between both hydraulic lines of said hydraulic motor;

a hydraulic pilot actuated communicating valve having switch positions with a first position and a second position, the first position being for closing said bypath line and the second position being for opening said bypath line; and a controller adapted to control the switch positions of said communicating valve, wherein the controller is adapted to set the communicating valve to the first position at said rotating position or said neutral position and then to set the communicating valve to the second position when the operating means is operated to be switched to said neutral position or said rotating position, respectively, as well as to allow the pressure oil of deceleration side at the time of stopping rotation, or the pressure oil of acceleration side at the time of starting rotation to be released by a predetermined time, wherein said controller is provided in a pilot line of said communicating valve and comprises a throttle valve, said throttle valve being adapted to set the communicating valve to the second position by a predetermined time.

7. A rotating control circuit for a working machine with a rotating body, comprising:

a hydraulic motor rotationally driven by supplying pressure oil from a pressure oil source via a direction control valve;

an operating means adapted to switch said direction control valve;

a bypath line connected to both hydraulic lines of said hydraulic motor;

a pilot operated communicating valve operated by a pilot signal from the operating means and having a first position for closing said bypath line and a second position for opening said bypath line; and a controller positioned to affect the pilot signal of said communicating valve and adapted to control said communicating valve, wherein the controller is constructed to set the communicating valve to the first position at the time when said operating means is operated for rotating and to set the communicating valve to the second position at the time when the operating means is returned to a neutral position, thereby allowing the pressure oil of deceleration side to be released by a predetermined time.

8. A rotating control circuit for a working machine with a rotating body, comprising:

a hydraulic motor rotationally driven by supplying pressure oil from a pressure oil source via a direction control valve;

an operating means adapted to switch said direction control valve;

a bypath line connected to both hydraulic lines of said hydraulic motor;

a communicating valve having a first position for closing said bypath line and a second position for opening said bypath line; and a controller adapted to control said communicating valve, wherein the controller is adapted to set the communicating valve to the first position at the time when said operating means is in a neutral position and to set the communicating valve to the second position when a rotating operation is started, thereby allowing the pressure oil of acceleration side to be released by a predetermined time.

* * * * *